US010875201B2

(12) United States Patent
Swanstrom

(10) Patent No.: US 10,875,201 B2
(45) Date of Patent: Dec. 29, 2020

(54) RELIEF GUARD FOR HAND TOOLS

(71) Applicant: SWANSTROM TOOLS USA INC., Superior, WI (US)

(72) Inventor: John O. Swanstrom, Maple, WI (US)

(73) Assignee: Swanstrom Tools USA Inc., Superior, WI (US)

( * ) Notice: Subject to any disclaimer, the term of this patent is extended or adjusted under 35 U.S.C. 154(b) by 0 days.

(21) Appl. No.: 16/375,365

(22) Filed: Apr. 4, 2019

(65) Prior Publication Data

US 2019/0308337 A1 Oct. 10, 2019

Related U.S. Application Data

(60) Provisional application No. 62/652,500, filed on Apr. 4, 2018.

(51) Int. Cl.

| | |
|---|---|
| ***B26B 29/04*** | (2006.01) |
| *B26B 13/16* | (2006.01) |
| *B26B 17/00* | (2006.01) |

(52) U.S. Cl.

CPC ..... *B26B 29/04* (2013.01); *B26B 13/16* (2013.01); *B26B 17/00* (2013.01)

(58) Field of Classification Search

CPC ..... B26B 29/04; B26B 13/16; B26B 17/00
USPC ..... 30/233
See application file for complete search history.

(56) References Cited

U.S. PATENT DOCUMENTS 1,174,175 A 3/1916 Moster
1,862,556 A 6/1932 Welhaven
2,146,132 A 2/1939 Scholl
2,323,497 A * 7/1943 Strout ..... B26B 17/00 30/124
2,386,328 A * 10/1945 Rollings ..... H02G 1/1224 30/91.2
2,507,345 A 5/1950 Meesook
2,521,027 A 9/1950 Sorensen
2,620,560 A 12/1952 Bahr
2,711,584 A 6/1955 Crider
2,990,735 A * 7/1961 Manning ..... H02G 1/12 30/91.2
3,010,206 A 11/1961 Curry
3,521,510 A * 7/1970 Angquist ..... B26B 13/16 81/417
3,597,104 A 8/1971 Salcumbe
3,654,647 A 4/1972 Neff
(Continued)

FOREIGN PATENT DOCUMENTS

DE 10 2009 044 107 A1 * 8/2011

OTHER PUBLICATIONS

"Swanstrom Tools for Electronics," Swanstrom Tools USA, 24 pp., 2002.

*Primary Examiner* — Hwei-Siu C Payer
(74) *Attorney, Agent, or Firm* — Faegre Drinker Biddle & Reath LLP

(57) ABSTRACT

A cutter comprising a first cutting portion having a first cutting edge, a second cutting portion having a second cutting edge and pivotally coupled to the first cutting portion, a relief aperture defined by the first and second cutting portions adjacent the first and second cutting edges, and a relief guard coupled to the first and second cutting portions to at least partially cover the relief aperture such that an object to be received between the first and second cutting portions is restricted from entering the relief aperture.

11 Claims, 6 Drawing Sheets

(56) References Cited

U.S. PATENT DOCUMENTS 3,675,517 A 7/1972 Tadayoshi
3,680,210 A 8/1972 Steinman
3,688,404 A 9/1972 Muller
3,735,453 A 5/1973 Nathans
3,739,662 A 6/1973 Windelman et al.
3,752,017 A 8/1973 Lloyd et al.
3,753,839 A 8/1973 Funke et al.
3,763,560 A * 10/1973 Makkay ..... B26B 17/00 30/124
3,765,277 A 10/1973 Sorensen
3,768,344 A 10/1973 Feldcamp
3,772,785 A 11/1973 Fischer
3,784,341 A 1/1974 Magalotti et al.
3,788,173 A 1/1974 Keigley
3,790,052 A 2/1974 Toll
3,795,957 A 3/1974 Steusloff et al.
3,813,966 A 6/1974 Knuth
3,822,470 A 7/1974 Hildebrand
3,830,351 A 8/1974 Cappotto
3,841,174 A 10/1974 Mcewan
3,859,950 A 1/1975 York
3,871,078 A 3/1975 Ogle
3,872,590 A 3/1975 Hill
3,893,372 A 7/1975 Strakeljahn
3,895,438 A 7/1975 Burkepile et al.
3,906,561 A 9/1975 Bawa
3,908,268 A * 9/1975 Brown ..... B25B 7/22 30/124
3,931,838 A 1/1976 Bakermans
3,949,473 A * 4/1976 Blanc ..... B26B 17/02 30/191
3,952,619 A 4/1976 Cook
3,963,391 A 6/1976 Thorburn et al.
3,979,034 A 9/1976 Larman
3,989,038 A 11/1976 Neward
3,991,796 A 11/1976 Dvorak
3,999,292 A 12/1976 Breese
4,001,064 A 1/1977 Nix
4,011,917 A 3/1977 Tiraspolsky et al.
4,016,941 A 4/1977 Sanders
4,024,898 A 5/1977 Bergler et al.
4,025,219 A 5/1977 Baumann et al.
4,028,756 A * 6/1977 Couto ..... H01R 43/042 7/107
4,050,152 A 9/1977 Olson
4,052,918 A 10/1977 Schmitz et al.
4,074,415 A 2/1978 Stieff
4,074,736 A 2/1978 Wolff
4,081,871 A 4/1978 Knuth
4,111,409 A 9/1978 Smith
4,122,569 A 10/1978 Hitchcock
4,130,031 A 12/1978 Wiener et al.
4,141,141 A * 2/1979 ViPond ..... B26B 13/16 30/186
4,151,644 A 5/1979 Locke
4,161,819 A 7/1979 Pietrantonio
4,173,070 A 11/1979 Vistain
4,174,560 A 11/1979 Senior et al.
4,179,956 A 12/1979 Gooley
4,180,358 A 12/1979 Uribe
4,187,046 A 2/1980 Atherton
4,189,966 A 2/1980 Keigley
4,212,150 A 7/1980 Dmochowski
4,229,882 A 10/1980 Chartier
4,242,797 A 1/1981 Palmieri et al.
4,247,983 A 2/1981 Jansson et al.
4,258,473 A 3/1981 Gutekunst
4,261,673 A 4/1981 Hougen
4,276,691 A 7/1981 Palmieri et al.
4,286,384 A 9/1981 Kotchy
4,326,334 A 4/1982 Roux
4,345,375 A 8/1982 Hayward
4,347,634 A 9/1982 Sawan
4,366,619 A 1/1983 Bieganski
4,366,762 A 1/1983 Willis
4,368,654 A 1/1983 Kober et al.
4,369,576 A 1/1983 McVaugh
4,375,773 A 3/1983 Liermann
4,384,390 A 5/1983 Hayakawa
4,414,869 A 11/1983 Augustine
4,437,376 A 3/1984 Flint
4,458,418 A 7/1984 McSmith et al.
4,459,717 A 7/1984 Halstead
4,459,883 A 7/1984 Astle
4,498,940 A 2/1985 Petersen
4,503,612 A 3/1985 Davis
4,543,718 A 10/1985 Duescher
4,557,034 A 12/1985 Pfundt
4,573,617 A 3/1986 Durkow
4,576,070 A 3/1986 Fitzgerald
4,598,744 A 7/1986 Bons et al.
4,608,761 A 9/1986 Small
4,610,279 A 9/1986 Stewart
4,627,164 A * 12/1986 Mikic ..... B26B 13/16 30/135
4,628,602 A * 12/1986 Koltermann ..... B26B 17/00 30/261
4,656,741 A 4/1987 Couture
4,685,214 A 8/1987 Shearon et al.
4,691,438 A 9/1987 Insolio
4,693,406 A 9/1987 Bartholomew et al.
4,708,182 A 11/1987 Laker
4,733,470 A 3/1988 Firman
4,735,245 A 4/1988 Cox
4,742,612 A 5/1988 Dokan et al.
4,763,406 A 8/1988 Rommel et al.
4,771,542 A 9/1988 Beveridge
4,785,538 A 11/1988 Meyer
4,787,614 A 11/1988 Givens
4,797,039 A 1/1989 Bosek
4,797,988 A 1/1989 Bowden, Jr. et al.
4,833,956 A 5/1989 Roberts
4,878,284 A 11/1989 Sawdon
4,902,177 A 2/1990 Burnett
4,910,923 A 3/1990 McCabe
4,924,571 A 5/1990 Albertson
4,934,219 A 6/1990 Edwards
4,944,422 A 7/1990 Aurness et al.
4,945,788 A 8/1990 Matthews
4,947,908 A 8/1990 O'Banion et al.
4,948,307 A 8/1990 Dodds
4,951,529 A 8/1990 Laurencot
4,955,137 A 9/1990 Matthews
4,966,238 A 10/1990 Shields
4,977,671 A 12/1990 Ducret
4,993,897 A 2/1991 Anderhalden
4,996,773 A 3/1991 Albertson
5,000,232 A 3/1991 Wolcott
5,024,257 A 6/1991 Lloyd
5,031,323 A 7/1991 Honsa et al.
5,033,195 A * 7/1991 Appelkvist ..... B26B 17/00 30/175
5,049,010 A 9/1991 Oakes
5,063,670 A 11/1991 Eberhardt et al.
5,083,351 A 1/1992 Gabathuler et al.
5,086,852 A 2/1992 Van Buskirk
5,134,776 A 8/1992 Moody
5,137,060 A 8/1992 Wolcott
5,142,825 A 9/1992 Floyd
5,143,492 A 9/1992 Leeb
5,156,156 A 10/1992 Ruzich
5,201,254 A 4/1993 Davies
5,235,750 A 8/1993 Brown
5,281,062 A 1/1994 Dunkman et al.
5,305,488 A 4/1994 Lyle
5,305,511 A 4/1994 Koehler et al.
5,311,803 A 5/1994 Crowley
5,318,389 A 6/1994 Strong et al.
5,320,119 A 6/1994 Griffiths
5,333,974 A 8/1994 Matsuura
5,337,479 A 8/1994 Ducret
5,347,894 A 9/1994 Fischer
5,435,237 A 7/1995 Huang

(56) References Cited

U.S. PATENT DOCUMENTS 5,446,964 A 9/1995 Woods et al.
5,475,927 A 12/1995 Dorma
5,499,453 A 3/1996 Brauchitsch
5,515,609 A 5/1996 Sperti
5,537,904 A 7/1996 Albin
5,542,435 A 8/1996 Kelly et al.
5,544,987 A 8/1996 Gipson
5,581,891 A 12/1996 Wheeler et al.
5,597,018 A 1/1997 Shipman
5,642,559 A 7/1997 Sawdon
5,653,033 A 8/1997 McDowell
5,662,436 A 9/1997 Bishop
5,680,875 A 10/1997 Winters
5,694,994 A 12/1997 Engler, III et al.
5,699,725 A 12/1997 Poltielov
5,782,588 A 7/1998 Gardner
5,806,190 A 9/1998 Robitaille
5,806,294 A 9/1998 Strieber
5,810,093 A 9/1998 Howard
5,810,472 A 9/1998 Penaranda et al.
5,827,018 A 10/1998 Blankenship et al.
5,868,208 A 2/1999 Peisert et al.
5,882,155 A 3/1999 Testa, Jr.
5,896,607 A 4/1999 Hagen
5,919,010 A 7/1999 Fonseca
5,943,780 A 8/1999 McIlhatten
5,953,822 A 9/1999 Vogelsanger
5,961,185 A 10/1999 Friant et al.
5,975,811 A 11/1999 Briese
5,988,027 A 11/1999 Lenox
6,026,720 A 2/2000 Swank
6,059,792 A 5/2000 Josephberg
6,081,952 A * 7/2000 Haxton ..... B25B 7/02 7/107
6,092,291 A 7/2000 Cendoma
6,135,566 A 10/2000 Anderson
6,151,783 A 11/2000 Morales
6,190,099 B1 2/2001 Schulz et al.
6,192,588 B1 2/2001 Krampe
6,202,522 B1 3/2001 Tremblay
6,203,419 B1 3/2001 Onken
6,223,801 B1 5/2001 Mitchell
RE37,321 E 8/2001 Poltielov
6,282,996 B1 9/2001 Berg et al.
6,298,512 B1 10/2001 Hagen
6,334,259 B1 1/2002 Harvey
6,338,375 B1 1/2002 Harada
6,351,865 B1 3/2002 De Donato
6,412,376 B1 7/2002 Borgia, Jr.
6,450,869 B1 9/2002 Sherez
6,487,776 B2 12/2002 Chang
6,543,141 B1 4/2003 Biehl
6,571,477 B1 6/2003 Mothena et al.
6,578,267 B2 6/2003 Seyfer
6,662,450 B1 12/2003 Ducret
6,671,944 B2 1/2004 Holliday et al.
6,763,543 B2 7/2004 Rivera
6,779,324 B2 8/2004 Hanes et al.
6,796,755 B2 9/2004 Angeloni
6,941,604 B2 9/2005 Ackeret
6,942,437 B2 9/2005 Ripley et al.
7,001,121 B2 2/2006 Kamphuis et al.
7,144,314 B2 12/2006 Pontieri
7,204,021 B2 4/2007 Houseman et al.
7,212,197 B1 5/2007 Schkolne et al.
7,216,431 B2 5/2007 Holliday et al.
7,350,314 B2 4/2008 McCambridge et al.
7,430,971 B2 10/2008 Kobayashi et al.
7,434,497 B2 10/2008 Caravello
7,591,037 B1 9/2009 Strickland
7,607,231 B2 10/2009 Klecker et al.
7,686,910 B2 3/2010 Habisreitinger et al.
7,793,570 B2 9/2010 Mattson et al.
7,887,270 B2 2/2011 Aho et al.
7,926,136 B2 4/2011 Yale et al.
7,954,404 B2 6/2011 Thielges et al.
7,958,923 B2 6/2011 Smythe, Jr.
8,043,030 B2 10/2011 Borschert et al.
8,113,094 B1 2/2012 Brackbill et al.
8,136,188 B2 3/2012 Bell
8,151,670 B2 4/2012 Nelson
8,307,912 B2 11/2012 Fisher
8,327,548 B2 12/2012 Ronan
8,336,453 B2 12/2012 Strautmann
8,428,781 B2 4/2013 Chang et al.
8,539,862 B1 9/2013 Robinson
8,550,883 B2 10/2013 Baumgartner et al.
8,661,922 B2 3/2014 Sales
8,701,799 B2 4/2014 Hall et al.
8,708,624 B1 4/2014 Marusiak
8,714,885 B2 5/2014 Itoh et al.
8,726,961 B2 5/2014 Druet et al.
8,764,440 B2 7/2014 Haber
8,807,881 B2 8/2014 Itoh et al.
8,818,548 B2 8/2014 Aoki et al.
8,826,789 B2 9/2014 Bagley
8,870,174 B2 10/2014 Mueller
8,915,916 B2 12/2014 Duncan
8,990,988 B2 3/2015 Robbins et al.
8,992,113 B2 3/2015 Campagna et al.
9,055,843 B2 6/2015 Stenglein et al.
9,102,077 B2 8/2015 Andersson et al.
9,119,638 B2 9/2015 Schwarz et al.
9,173,813 B2 11/2015 Nino et al.
9,387,967 B2 7/2016 Curry et al.
9,391,435 B2 7/2016 Woodward
9,394,068 B2 7/2016 Dyer
9,399,269 B2 7/2016 Zediker et al.
9,433,198 B2 9/2016 O'Neal
9,512,690 B2 12/2016 Grigor et al.
9,630,299 B1 4/2017 Lien
9,676,106 B2 6/2017 Garavaglia et al.
9,724,840 B2 8/2017 Gass
9,744,686 B2 8/2017 Engelfried et al.
9,751,201 B2 9/2017 King, Jr. et al.
9,776,264 B2 10/2017 Shaw
9,815,212 B2 11/2017 Barr
9,820,445 B2 11/2017 Simpson et al.
9,862,120 B2 1/2018 Hellberg
9,943,971 B2 * 4/2018 Stanley ..... A61B 17/8863
2002/0064438 A1 5/2002 Osborne
2002/0133264 A1 9/2002 Maiteh et al.
2002/0174755 A1 11/2002 Behne et al.
2002/0194734 A1 12/2002 Huang
2003/0014868 A1 1/2003 Cech et al.
2003/0106159 A1 6/2003 Ackeret et al.
2003/0219321 A1 11/2003 Borschert et al.
2003/0233734 A1 12/2003 McGuyer et al.
2004/0107806 A1 6/2004 Gruber
2004/0250786 A1 12/2004 Kruse et al.
2004/0261188 A1 12/2004 Mathis
2005/0142515 A1 6/2005 Levy et al.
2005/0252269 A1 11/2005 Sawdon et al.
2005/0279517 A1 12/2005 Hoffman et al.
2006/0070187 A1 4/2006 Chilson
2006/0106395 A1 5/2006 Link et al.
2006/0112800 A1 6/2006 Hogan et al.
2006/0195107 A1 8/2006 Jones et al.
2006/0216125 A1 9/2006 Glimpel et al.
2006/0236839 A1 10/2006 Munch et al.
2007/0012157 A1 1/2007 D'Addario
2007/0028936 A1 2/2007 Kriser
2007/0039191 A1 2/2007 Janutin et al.
2007/0081872 A1 4/2007 Blomstedt et al.
2007/0081873 A1 4/2007 Blomstedt et al.
2007/0108944 A1 5/2007 Pellenc
2007/0149881 A1 6/2007 Rabin
2007/0149980 A1 6/2007 Seedhom et al.
2007/0191857 A1 8/2007 Allard et al.
2008/0016700 A1 1/2008 Hernandez et al.
2008/0063218 A1 3/2008 Weber et al.
2008/0064983 A1 3/2008 Stromberg et al.
2008/0067277 A1 3/2008 Jungklaus
2008/0163494 A1 7/2008 Larkin

(56) References Cited

U.S. PATENT DOCUMENTS

| | | | |
|---|---|---|---|
| 2008/0173321 | A1 | 7/2008 | Le |
| 2008/0200928 | A1 | 8/2008 | Calvo et al. |
| 2008/0271325 | A1 | 11/2008 | Hurley |
| 2009/0003953 | A1 | 1/2009 | Kvalheim |
| 2009/0126133 | A1 | 5/2009 | Ryu |
| 2009/0127521 | A1 | 5/2009 | Foley |
| 2009/0229479 | A1 | 9/2009 | Nelson |
| 2009/0302496 | A1 | 12/2009 | Lukis et al. |
| 2009/0308218 | A1 | 12/2009 | Raff et al. |
| 2010/0051052 | A1 | 3/2010 | Mason |
| 2010/0107846 | A1 | 5/2010 | Lee et al. |
| 2010/0263219 | A1 | 10/2010 | Kempker et al. |
| 2011/0061246 | A1 | 3/2011 | Martinsson et al. |
| 2011/0078905 | A1 | 4/2011 | Macsay et al. |
| 2011/0177322 | A1 | 7/2011 | Ogrin et al. |
| 2011/0194885 | A1 | 8/2011 | Whitenight et al. |
| 2011/0214299 | A1 | 9/2011 | Heh |
| 2012/0005838 | A1 | 1/2012 | Ellington |
| 2012/0180322 | A1 | 7/2012 | Takeda et al. |
| 2012/0267127 | A1 | 10/2012 | Arigoni |
| 2013/0061475 | A1 | 3/2013 | Lutgen et al. |
| 2013/0061479 | A1 | 3/2013 | Lutgen et al. |
| 2013/0190156 | A1 | 7/2013 | Matsukawa |
| 2013/0205596 | A1 | 8/2013 | Pellenc |
| 2013/0269192 | A1 | 10/2013 | Pellenc |
| 2013/0326882 | A1 | 12/2013 | Harvey |
| 2014/0304993 | A1 | 10/2014 | Rafii |
| 2015/0082677 | A1 | 3/2015 | Crump et al. |
| 2015/0125229 | A1 | 5/2015 | Glimpel et al. |
| 2015/0151447 | A1 | 6/2015 | Petersson et al. |
| 2015/0202781 | A1 | 7/2015 | Chung et al. |
| 2015/0217461 | A1 | 8/2015 | Langenwalter et al. |
| 2015/0251257 | A1 | 9/2015 | Shaw |
| 2016/0015157 | A1 | 1/2016 | Nouri |
| 2016/0036206 | A1 | 2/2016 | Zhang |
| 2016/0193744 | A1 | 7/2016 | Patel |
| 2016/0233539 | A1 | 8/2016 | Sastry et al. |
| 2016/0288351 | A1 | 10/2016 | Garavaglia et al. |
| 2017/0043418 | A1 | 2/2017 | Pierce et al. |
| 2017/0182583 | A1 | 6/2017 | Mizutani |
| 2017/0266803 | A1 | 9/2017 | Hardinge et al. |
| 2017/0322539 | A1 | 11/2017 | Kholodkova et al. |
| 2018/0040910 | A1 | 2/2018 | Chung et al. |
| 2018/0056409 | A1 | 3/2018 | Caglar et al. |
| 2019/0308337 | A1* | 10/2019 | Swanstrom ..... B26B 29/04 |

* cited by examiner

RELIEF GUARD FOR HAND TOOLS

CROSS-REFERENCE TO RELATED APPLICATION

This application claims priority to Provisional Application No. 62/652,500, filed Apr. 4, 2018, which is herein incorporated by reference in its entirety.

TECHNICAL FIELD

The present invention is in the field of hand tools. More specifically, the present invention is directed to hand tools for cutting and having a relief guard.

BACKGROUND

Traditionally, severing hand tools, such as shears and cutters, are configured to sever objects, such as wires, when the objects are positioned between the cutting edges. However, it is difficult to position a wire to between the cutting edges with high accuracy and repeatability, especially at high volume operations. This is largely due to over-insertion of an object beyond the cutting edges and into a stress relief aperture adjacent the cutting edges. There remains a continuing need for improved hand tools enabling a user to position an object between the cutting edges with increased accuracy and repeatability.

SUMMARY

Various aspects of the disclosure relate to cutters comprising a first cutting portion having a first cutting edge, a second cutting portion having a second cutting edge and pivotally coupled to the first cutting portion. The cutters may further include a relief aperture defined by the first and second cutting portions adjacent the first and second cutting edges. The cutters may further include a relief guard coupled to the first and second cutting portions to at least partially cover the relief aperture such that an object to be received between the first and second cutting portions is restricted from entering the relief aperture.

Additionally, various aspects of the disclosure relate to hand tool kits including a hand tool and a plurality of relief guards configured to be coupled to the hand tool. The hand tool may include a first cutting portion having a first cutting edge and a second cutting portion having a second cutting edge and pivotally coupled to the first cutting portion. The hand tool may further include a relief aperture defined by the first and second cutting portions adjacent the first and second cutting edges. Each of the relief guards may differ by at least one of a length, an angle, and a width, and configured to at least partially cover the relief aperture such that an object to be received between the first and second cutting portions is restricted from entering the relief aperture.

While multiple inventive examples are specifically disclosed, various modifications and combinations of features from those examples will become apparent to those skilled in the art from the following detailed description. Accordingly, the disclosed examples are meant to be regarded as illustrative in nature and not restrictive.

Figure 1:
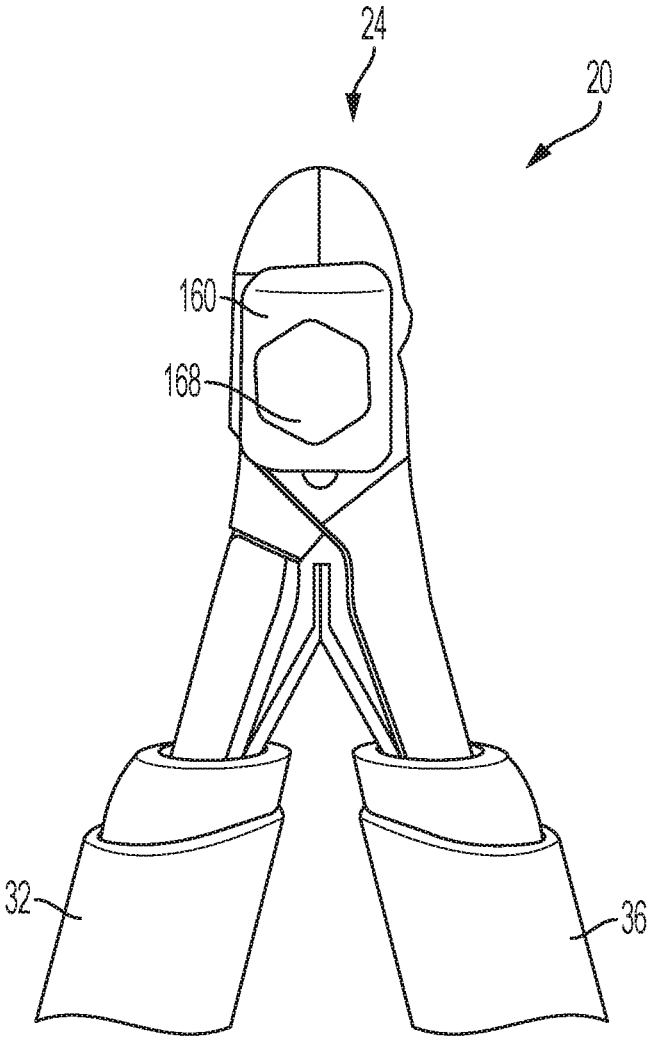
FIG. 1 shows a cutter in a closed position, according to some examples.

While the disclosure is amenable to various modifications and alternative forms, specific embodiments have been shown by way of example in the drawings and are described in detail below. The disclosure, however, is not limited to the particular embodiments described. On the contrary, the disclosure is intended to cover all modifications, equivalents, and alternatives falling within the scope of the disclosure as defined by the appended claims.

DETAILED DESCRIPTION

Figure 2A:
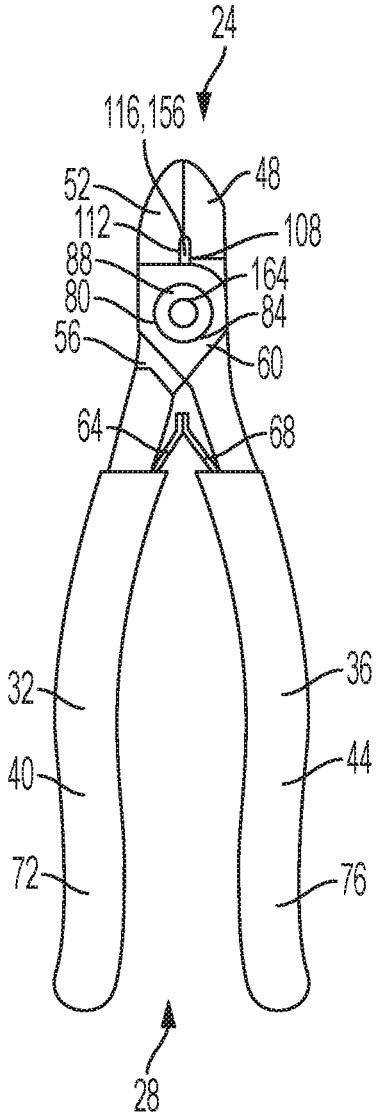
FIG. 2A shows the cutter of FIG. 1 absent a relief guard, viewing from the front, according to some examples.
Figure 2B:
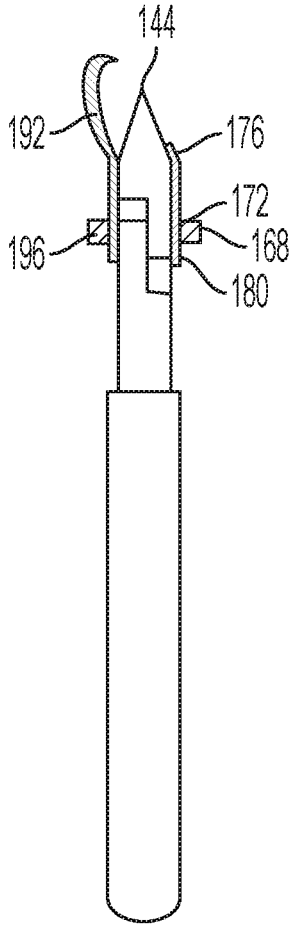
FIG. 2B shows the cutter of FIG. 1, including a catch, viewing from the side, according to some examples.
Figure 3:
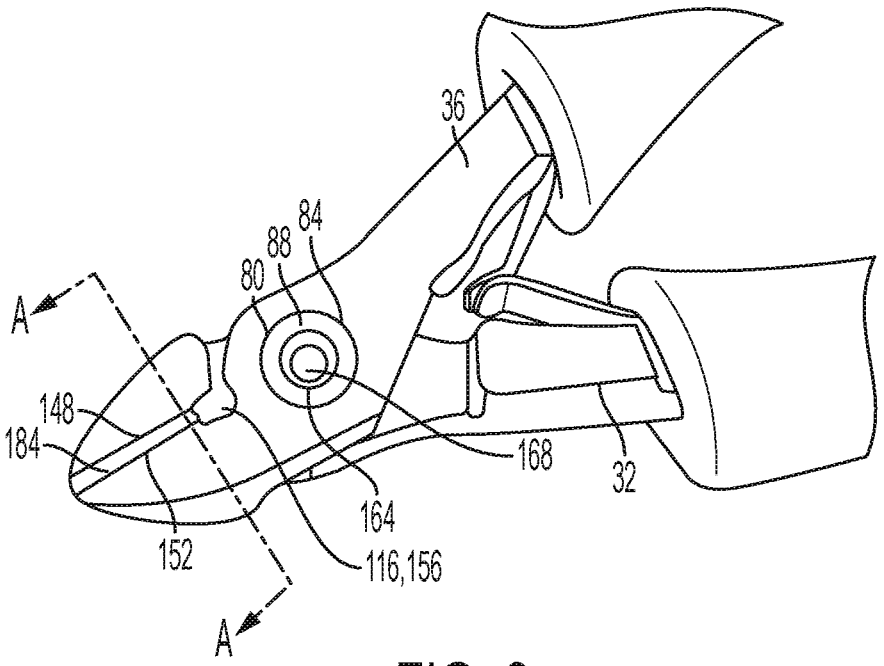
FIG. 3 shows the cutter of FIG. 1 in an opened position absent the relief guard, according to some examples.
Figure 4:
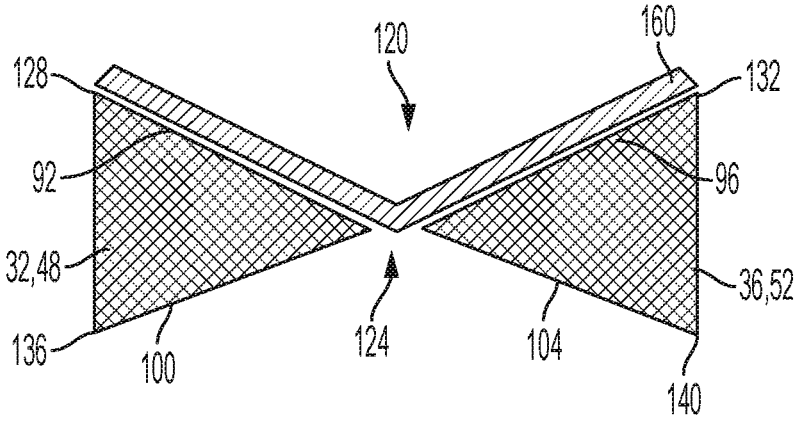
FIG. 4 shows a cross-sectional view (A-A section) of the cutter of FIG. 3 with the relief guard, according to some examples.
Figure 5:
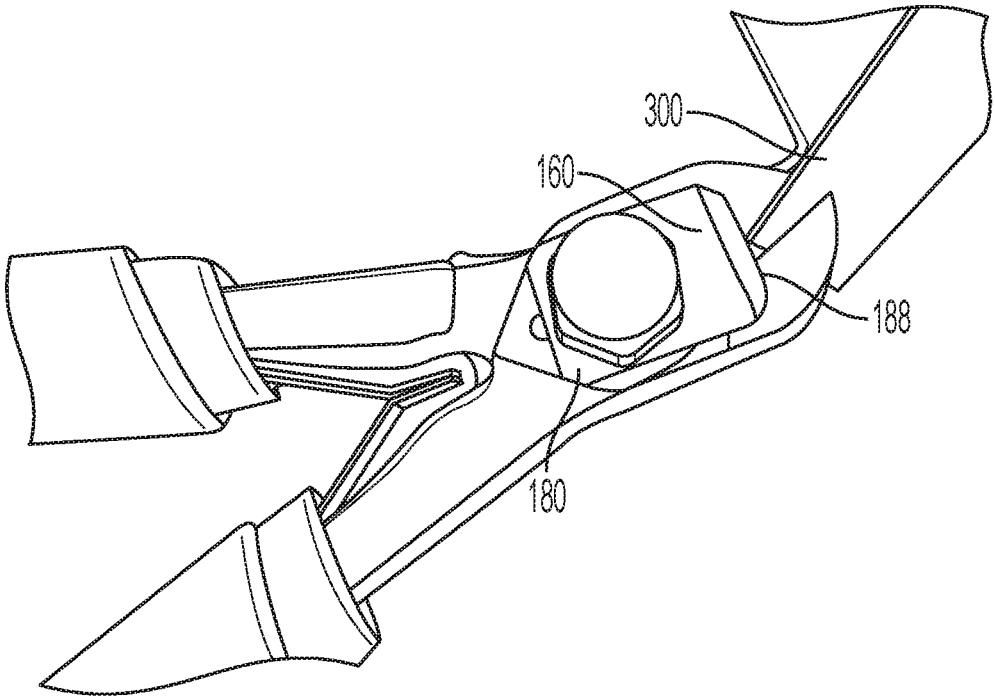
FIG. 5 shows the cutter of FIG. 1 having an object positioned between the cutting edges and adjacent the relief guard, according to some examples.

FIG. 1 shows a cutter 20 in a closed position, according to some examples. FIG. 2A shows the cutter 20 of FIG. 1 absent a relief guard 160, viewing from the front, according to some examples. FIG. 2B shows the cutter 20 of FIG. 1, including a catch 192, viewing from the side, according to some examples. FIG. 3 shows the cutter 20 of FIG. 1 in the opened position absent the relief guard 160, according to some examples. FIG. 4 shows a cross-sectional view (A-A section) of the cutter 20 of FIG. 3 with the relief guard 160, according to some examples. FIG. 5 shows the cutter 20 of FIG. 1 having an object 300 positioned between the cutting edges 148, 152 and adjacent the relief guard 160, according to some examples. It is to be understood that the features described for the cutter 20 in the present disclosure may by adapted to any other hand tool known to one skilled in the art. The cutter 20 includes a distal end 24, a proximal end 28, a first arm member 32 (also described as a first jaw member 32), and a second arm member 36 (also described as a second jaw member 36). Each of the arm members 32, 36 includes a handle portion 40, 44 extending from the proximal end 28, a cutting portion 48, 52 extending from the distal end 24, and a pivot portion 56, 60 between the handle and cutting portions, respectively. Each of the arm members 32, 36 may further include a spring 64, 68, respectively, to bias the cutter 20 into an opened position (see FIG. 3). Each of the arm members 32, 36 may further include a handle cover 72, 76, respectively. Each of the arm members 32, 36 includes a pivot opening 80, 84 at the pivot portion 56, 60, respectively, and configured to receive a pivot member 88 to pivotally couple the arm members.

As shown, each of the arm members 32, 36 has a front surface 92, 96 and a back surface 100, 104, respectively, at the cutting portions 48, 52. The front surfaces 92, 96 may be configured to be mirrored (e.g., mirrored from a cutting plane) and may be flat, and/or slanted (e.g., by at least 15°), or curved, and may define a front cutting pocket 120 (see FIG. 4). Additionally or alternatively, the back surfaces 100, 104 may be configured to be mirrored (e.g., mirrored from a cutting plane) and may be flat, and/or slanted, or curved, and may define a back cutting pocket 124 (see FIG. 4). Each of the arm members 32, 36 has a front edge 128, 132, and a back edge 136, 140, in which the distance (i.e., height) between the front and back edge is greater near the pivot portion 56, 60 than near the distal end 24 of the cutter 20 (FIG. 4). The front edges 128, 132 and back edges 136, 140 may meet at the distal end to form a tip 144. Each of the arm members 32, 36 has a cutting edge 148, 152 at the cutting portion 48, 52. The cutting edges 148, 152 are configured to mate in the closed position and may extend from the distal end 24 or the tip 144. The cutting edges 148, 152 may be linear and define a cutting line in the closed position. The cutting line may further define the cutting plane in which the cutter 20 on one side of the cutting plane is generally mirrors the cutter on the other side of the cutting plane.

As shown, each of the arm members 32, 36 may include a recess 108, 112 at the cutting portion 48, 52 near the pivot portion 56, 60, respectively. For example, the recesses 108, 112 may adjacent the cutting edges 148, 152 near the pivot portions 56, 60. As shown in FIG. 2A, the recesses 108, 112 are configured to form a stress relief aperture 116 of the cutter 20 when in the closed position. Alternatively or additionally, the stress relief aperture 116 may be a stripping aperture 156 configured to remove an outer portion (e.g., wire insulation) and not an inner portion (e.g., metal wire) of an object 300 (e.g., electrical wire). The cutter 20 further includes a relief guard 160 configured to be coupled, such as removably coupled to the cutter, such as to the pivot portions 56, 60. For example, the cutter 20 or the pivot member 88 may define a securing opening 164 configured to receive a first securing element 168 (e.g., a bolt, a screw, a magnet, or a clip) to secure the relief guard 160 to the cutter 20 (e.g., the first securing element 168 may be manually secured (e.g., rotated) by a user. The relief guard 160 may define a securing opening 172 configured to be aligned to the first securing element 168. The relief guard 160 may be adjusted, such as slideably adjusted relative to the cutter 20, (e.g., when at least one of the securing openings 164, 172 is a slot). The relief guard 160 may be coupled to the front and/or the back of the cutter 20. As shown in FIG. 2B, the cutter 20 may further include a catch 192, such as a lead catch, configured to be coupled to the cutter to contain and/or limit the length of the severed portion of an object. The catch 192 may be coupled to the cutter 20 on the same or opposite side of the relief guard 160 by the first securing element 168 or a second securing element 196.

As shown in FIG. 1 and FIG. 2B, the relief guard 160 may include a distal portion 176 and a proximal portion 180 generally in contact with the pivot portion 56 or 60. The distal portion 176 may be configured to contact or be near the front 92, 96 and/or the back 100, 104 surfaces of the cutter 20 in the closed position. For example, the distal portion 176 of the relief guard 160 may take on the shape or curvature of the cutting portions 48, 52 (e.g., to be flushly coupled) to limit interference to the front cutting pocket 120 and/or the back cutting pocket 124. In some examples, the relief guard 160 has a slant, or angle in the distal direction, or longitudinal direction of about 15 degrees or more so that the relief guard 160 generally tracks the surface of the cutting portions 48, 52. The relief guard 160 may also have a centrally-oriented angle or curve (e.g., a valley, or inward angle to define a "v-shape" or bent with an apex angle of about 15 degrees or more, for example. Alternatively, the relief guard 160 may be flat such that the distal and proximal portions 176, 180 are coplanar. The securing opening 172 may be defined by the proximal portion 180 of the relief guard 160. The relief guard 160 is configured to be coupled or secured to the cutter 20 such that the relief aperture 116 is at least partially covered by the relief guard. FIG. 1 shows the relief aperture 116 fully covered by the relief guard 160. In various embodiments, at least one of the arm members 32, 36 define a guard recess (not shown) at the pivot portion 56, 60 configured to receive the relief guard 160 (e.g., to help align the relief guard to the cutting pocket 120 or 124). The relief guard 160 may be metal, plastic, and/or composite.

As shown in FIGS. 3-5, the cutting edges 148, 152 are apart in the opened position to define a cutting opening 184 configured to receive an object 300 to be cut (e.g., notched, severed, trimmed, or otherwise cut). The object 300 may be an electrical wire or a plastic part, such as a length of L-channel or other shape. The cutting opening 184 may extend from the distal end 24 or tip 144 along the cutting edges 148, 152 to the relief guard 160, such as to a distal edge 188 of the relief guard. The cutter 20 including the relief guard 160 enables the object 300 (i.e., object severable by the cutter) to be severable when positioned anywhere along the cutting opening 184. The relief guard 160 help limit the insertion of the object 300 into the cutter 20, for example, the cutting portions 48, 52 such that at least part (e.g., entirety) of the object is positioned outside of the relief aperture 116 as a user actuates the cutter from the opened state to the closed state, as shown in FIG. 5.

Figure 6:
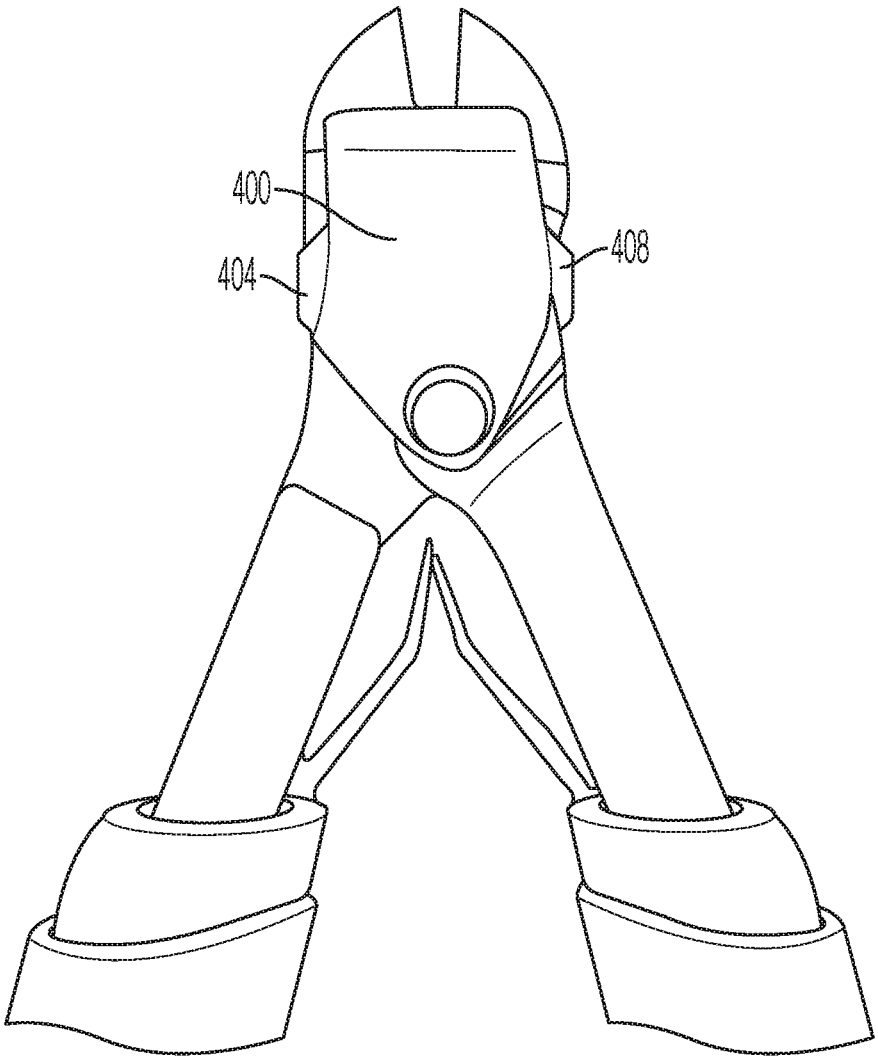
FIG. 6 shows the cutter of FIG. 1 having a relief guard with stabilizing elements, according to some examples.

FIG. 6 shows the cutter 20 of FIG. 1 having a relief guard 400 including a first stabilizing element 404 and a second stabilizing element 408, according to some examples. Although a pair of opposing stabilizing elements are shown, it should be understood that a single stabilizing element may be applied as desired. Relief guard 400 may include all features described for relief guard 160 and be used in a cutter substantially the same way. As shown, the first stabilizing element 404 (e.g., also described as a first tab) and optionally a second stabilizing element 408 (e.g., a second tab) may be configured to improve stability of the relief guard 400 such that it remains in position (e.g., coupled flush) during use, such as upon engagement with a workpiece (e.g., object 300 of FIG. 5) or during transition between the opened and closed positions. As shown, each of the first and second stabilizing elements 404, 408 is an angled projection (e.g., bent at approximately 90 degrees) engaging with sides of the first and second arm members 32, 36, respectively to help maintain the relief guard 400 in position (e.g., aligned to cutting portion 48, 52 to cover/block the relief aperture, and optionally portions of the cutting edges).

Figure 7:
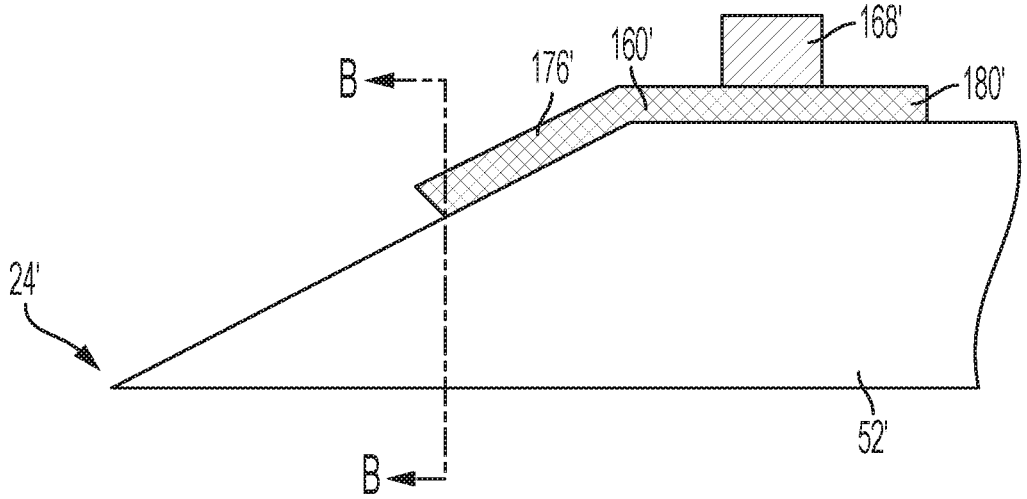
FIG. 7 shows a cutter, viewing from the side, according to some examples.
Figure 8:
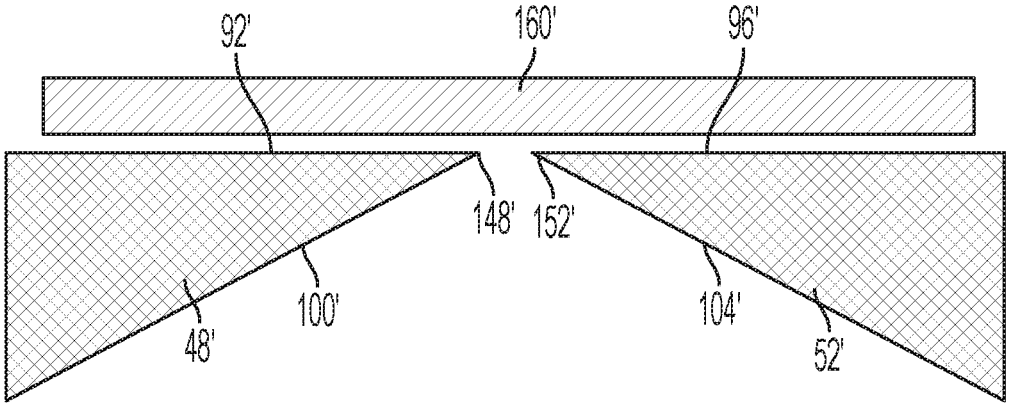
FIG. 8 shows a cross-sectional view (B-B section) of the cutter of FIG. 7, according to some examples.

FIG. 7 shows a cutter 20', viewing from the side, FIG. 8 shows a cross-sectional view (B-B section) of the cutter of FIG. 7, according to some examples. Cutter 20' may be significantly similar to cutter 20 and may include any of the features described for cutter 20. As illustrated, cutter 20' includes a first cutting portion 48' and a second cutting portion 52' near its distal end 24'. The first cutting portion 48' has a front surface 92', a back surface 100', and a first cutting edge 148'. The second cutting portion 52' has a front surface 96', a back surface 104', and a second cutting edge 152'. Cutter 20' further include a relief guard 160' coupled to the first and second cutting portions 48', 52' by a first securing element 168'. The relief guard 160' has a distal portion 176' and a proximal portion 180' and may generally track the front surfaces 92', 96' or back surfaces 100', 104' of the cutting portions 48', 52' when attached. In the illustrated example, the front surfaces 92', 96' are generally parallel or coplanar such that the relief guard 160' coupleable to the front surfaces may have a generally planar distal portion 176'. The relief guard 160' may define an angle at the transition of the distal portion 176' and proximal portion 180'. The angle may be, for example, about 15 degrees, between 5 and 40 degrees, or any of a variety of values. Alternatively or additionally, a cross-section of the distal portion 176' may be V-shaped or U-shaped.

A hand tool kit may include a hand tool, such as hand tool 20, and a plurality of relief guards configured to be coupled to the hand tool. One or more of the plurality of relief guards may be similar or identical to relief guard 160. The hand tool of the hand tool kit may include a first cutting portion having a first cutting edge, a second cutting portion having a second cutting edge and pivotally coupled to the first cutting portion. The hand tool may further include a relief aperture defined by the first and second cutting portions adjacent the first and second cutting edges. Each of the plurality of relief guards may differ by at least one of a length, an angle, and a width, and configured to at least partially cover the relief aperture such that an object, such as object 300, to be received between the first and second cutting portions is restricted from entering the relief aperture. The hand tool kit may further include one or more catches coupleable to the hand tool of the hand tool kit by one of one or more securing elements. At least one of the one or more catches may be similar or identical to catch 192. Each of the one or more catches may differ by at least one of a length, an angle, a curvature, and a width.

Various modifications and additions can be made to the exemplary embodiments discussed without departing from the scope of the present disclosure. For example, while the embodiments described above refer to particular features, the scope of this disclosure also includes embodiments having different combinations of features and embodiments that do not include all of the described features. Accordingly, the scope of the present disclosure is intended to embrace all such alternatives, modifications, and variations as fall within the scope of the claims, together with all equivalents thereof.

What is claimed is:

1. A cutter comprising:

a first cutting portion having a first cutting edge;

a second cutting portion having a second cutting edge and pivotally coupled to the first cutting portion;

a relief aperture defined by the first and second cutting portions adjacent the first and second cutting edges; and a relief guard coupled to the first and second cutting portions to at least partially cover the relief aperture such that an object to be received between the first and second cutting portions is restricted from entering the relief aperture, wherein at least one of a front cutting pocket and a back cutting pocket is defined by the first and second cutting portions, the relief guard including a proximal region and a distal region configured to be generally flush against either the front or back cutting pocket.

2. The cutter of claim 1, wherein the relief guard is adjustably coupled to the first and second cutting portions.

3. The cutter of claim 1, wherein the relief guard defines an adjustment slot.

4. The cutter of claim 1, wherein the first cutting portion extends from a first arm member and the second cutting portion extends from a second arm member, and further wherein each of the first and second arm members has a pivot portion to which the relief guard is coupled.

5. The cutter of claim 4, further comprising a catch coupled to either the first arm member or the second arm member to contain a severed portion of the object.

6. The cutter of claim 1, further comprising a distal end and the relief guard including a distal edge, wherein the cutting edges define a cutting opening extending from the distal end to the distal edge.

7. The cutter of claim 1, wherein the relief aperture includes a stripping feature.

8. The cutter of claim 1, wherein the relief guard further includes one or more stabilizing elements.

9. A hand tool kit comprising:

a hand tool including, a first cutting portion having a first cutting edge;

a second cutting portion having a second cutting edge and pivotally coupled to the first cutting portion;

a relief aperture defined by the first and second cutting portions adjacent the first and second cutting edges; and a plurality of relief guards configured to be coupled to the hand tool, each of the relief guards differing by at least one of a length, an angle, and a width, wherein each of the relief guards is configured to at least partially cover the relief aperture such that an object to be received between the first and second cutting portions is restricted from entering the relief aperture.

10. The kit of claim 9, further comprising one or more catches, wherein any of the one or more catches is coupleable to the hand tool by one or more securing elements.

11. The kit of claim 9, further comprising a plurality of catches differing from one another by at least one of a length, an angle, a curvature, and a width.

* * * * *